United States Patent [19]

Wang et al.

[11] 4,104,516

[45] Aug. 1, 1978

[54] DIRECT VIEW, PANEL TYPE X-RAY IMAGE INTENSIFIER TUBE

[75] Inventors: Shih-Ping Wang, Los Altos; Charles D. Robbins, Los Altos Hills; Elisha Merritt, Sunnyvale, all of Calif.

[73] Assignee: Diagnostic Information Inc., Sunnyvale, Calif.

[21] Appl. No.: 763,638

[22] Filed: Jan. 28, 1977

[51] Int. Cl.[2] ..... H01J 31/50

[52] U.S. Cl. ..... 250/213 VT; 313/94

[58] Field of Search ..... 250/213 R, 213 VT, 207; 313/94, 95, 103 R

[56] References Cited

U.S. PATENT DOCUMENTS

| | | | |
|---|---|---|---|
| 3,590,304 | 6/1971 | Moegenbier | 313/94 |
| 3,890,506 | 6/1975 | Berninger | 250/213 VT |

*Primary Examiner*—David C. Helms

*Attorney, Agent, or Firm*—Limbach, Limbach & Sutton

[57] ABSTRACT

A panel shaped, proximity type, x-ray image intensifier tube for medical x-ray fluoroscopy use having all linear components and yet a high brightness gain, in excess of 4,000 cd-sec/m$^2$-R, the tube being comprised of a rugged metallic tube envelope, an inwardly concave metallic input window, a directly viewable full size output display screen, and a scintillator-photocathode screen having a thickness of at least 200 microns for a high x-ray photon utilization ability as well as x-ray stopping power, the scintillator-photocathode screen being suspended on insulators within the envelope and in between the input window and the output screen. The scintallator-photocathode screen is spaced from the output screen by at least 8mm to allow the application of a high negative potential at the scintillator-photocathode screen with respect to the output screen for high gain with low field emission, since all of the remaining components within the tube envelope are at neutral potential with respect to the output display screen.

11 Claims, 7 Drawing Figures

DIRECT VIEW, PANEL TYPE X-RAY IMAGE INTENSIFIER TUBE

CROSS REFERENCE TO RELATED APPLICATIONS

This application is related to the following co-pending applications filed by S. P. Wang, one of the joint inventors in the present application: Ser. No. 741,430, entitled "X-Ray Radiographic Camera", filed Nov. 12, 1976; Ser. No. 763,637, entitled "X-Ray Image Intensifier Tube", filed Jan. 28, 1977, both of which are now abandoned; and Ser. No. 853,440, filed Nov. 21, 1977, entitled "Panel Type X-Ray Image Intensifier Tube and Radiographic Camera System".

BACKGROUND OF THE INVENTION

The invention pertains to x-ray apparatus, and more particularly to a real-time, direct viewing, x-ray image intensifier tube of the proximity type for medical x-ray fluoroscopy.

An early type of real-time, direct viewing, x-ray device is a fluoroscope. With such a device, the patient is positioned between the source of x-rays and the device. The device consists of a thick, green light emitting fluorescent screen, also known as the fluoroscopic screen which has a low resolution and a low conversion efficiency in the range of 70 ergs per square centimeter-roentgen (erg/cm$^2$-R) or about 10 candela-second per square meter-roentgen (cd-sec/m$^2$-R). This type of x-ray apparatus, although it allows real-time, direct viewing of a full size image, and easy palpation of the patient, is no longer in popular medical use. This is because the brightness or the conversion efficiency of this system is far low than that of the well-accepted inverter type of x-ray image intensifer system. The low brightness of the old-time fluoroscopic screen forces the physicians to work in a darkened room with dark-adapted eyes. The long time (e.g., good portion of an hour) required for dark-adaptation, which was often out of proportion to the brevity of the examination itself, was a great inconvenience and a poor use of time to physicians. Furthermore, in a darkened room, the viewing condition is more strenuous, movement about the room or manipulation of the patient is more difficult, and the possibility of a group viewing is less satisfactory. Darkened room also adds unnecessary apprehension to patients.

In a well-known study by R.E. Sturm and R.H. Morgan, published in *The American Journal of Roentgenology and Radium Therapy,* Volume 62, (1949) pages 617–634, it was found that visual acuity and contrast discrimination were compromised by the low conversion efficiency of the old-time fluoroscopic screen. It was further stated that maximum improvement in both visual acuity and contrast discrimination may be obtained with an ideal screen intensifier at gains of 30 to 50 times (approximately 300 to 500 cd-sec/m$^2$-R), and gains of 500 to 1000 times (approximatley 5,000 to 10,000 cd-sec/m$^2$-R) are needed in practical instruments if dark adaptation is to be avoided.

The applicants have also confirmed the findings of Sturm and Morgan that a conversion efficiency in the range of 5,000 to 10,000 cd-sec/m$^2$-R are practical for direct viewing medical x-ray fluoroscopy.

The common present day real-time x-ray fluoroscopy is done with a television (TV) fluoroscopy system. See FIG. 1. This system uses a closed-circuit TV optically coupled to a conventional inverter type x-ray image intensifier tube which has a minified output image size. In such a system, the patient again is positioned between the source of the x-rays and the system. The conventional inverter type x-ray image intensifier tube typically has a convexly curved, six to nine inch diameter input x-ray sensitive screen which converts the x-ray image into a light image which, in turn, is converted into electrons which are then accelerated and electrostatically focused onto an output image screen which is considerably smaller than the input screen, being typically 0.6 inches to 1.0 inches in diameter. During fluoroscopy, the TV monitor is placed to one side of the patient and therefore the doctor must turn away from the patient to view the x-ray image display on the television monitor.

Some direct viewing fluoroscopic systems may be found today, which have a mirror and lens system coupled to the conventional inverter type x-ray image intensifier tube. This mirror/lens system is necessary to allow the output image to be magnified and inverted to the upright position for direct viewing. The limited exit aperture of this optical system is a great inconvenience to the physicians. The physicians's head has to follow the system around during "panning" or scanning of the patient. Also, group viewing is very difficult with this system.

The conversion efficiency of the conventional inverter type image intensifier tube used in TV fluoroscopic or direct viewing fluoroscopic systems is usually around 200,000 to 700,000 erg/cm$^2$-R or about 50,000 to 100,000 cd-sec/m$^2$-R, which is about 3,000 to 10,000 times the conversion efficiency of the old-time fluoroscopic screen. Part of this intensification is obtained as true electronic gain, or the gain at unity magnification (output size same as input size), which is about 30 to 100 times over the old-time fluoroscopic screen. Another factor of 100 gain is obtained through the 100 fold area minification of the image on the output screen. It is important to note here that without area minification gain, the conversion efficiency of this device is about 30 – 100 which is not adequate for direct viewing fluoroscopy.

The conventional inverter type x-ray image intensifier system has basic limitations in maintaining the image quality if the input field size is to expand beyond the typical nine inch diameter. The intensifier tube contains a vacuum and the electron optics of this design requires a tube length approximate to that of the tube diameter. Thus, the large vacuum space contained by the tube represents a stored potential energy which could be a major hazard in the form of a massive implosion. The electron optics of this tube demand that the input screen must be strongly curved so that all parts of the screen can be brought into focus on the output screen. This curved input screen creates spatial distortion in the image due to the projection of the x-ray shadow image onto a curve surface. Furthermore, the electron optics are such that electrons leaving different parts of the input surface experience a difference in electrical fields which results in uneven sharpness in the image from the center of the screen to the edge. Another factor is that the conventional closed circuit TV system has only 1.5 line pairs/mm limiting resolution.

The foregoing mentioned shortcomings of current fluoroscopic systems are recognized by the physicians and by the workers in the field. There had been numerous attempts at overcoming these shortcomings. The art which is closest to the invention is described below.

A recent article published by C. B. Johnson in the *Proceedings of the Society of Photo Optical Instrumentation Engineers,* Volume 35, pages 3–8 (1973), hypothetically suggests that an x-ray sensitive proximity type image intensifier may be designed with an x-ray sensitive conversion screen on one side of a glass support and a photocathode on the other side of the glass support. However, the article gives no specifics concerning the critical parameters or what might be used as the x-ray sensitive conversion screen. How this image intensifier can be designed to result in high conversion efficiency without the help of area minification was also not discussed.

A proximity device using a microchannel plate (MCP) both as the primary x-ray sensitive conversion screen and as an electron multiplication device was described by S. Balter and his associates in *Radiology,* Volume 110, pages 673–676 (1974), and by Manley et al in U.S. Pat. No. 3,394,261. According to an article published by J. Adams in *Advances in Electronics and Electron Physics,* Volume 22A (Academic Press, 1966), pages 139–153, this type of device has a very low quantum detection efficiency in the practical medical diagnostic x-ray energy range of 30 – 100 Kev. The device gain of the Balter article was first reported to be 20 – 30 cd-sec/m$^2$-R which is too low to be useful as a fluoroscopic device. A higher gain device described in the same Balter article exhibited excessive noise. There is a real question whether a practical self-supporting MCP plate with uniform gain can be constructed with current technology to sizes beyond five inches in diameter which is not of sufficient size to produce an output useful for fluoroscopic purposes.

Another approach involving proximity design was taken by I.C.P. Millar and his associates and their results were published in 1) *IEEE Transactions on Electron Devices,* Volume ED-18, pages 1101–1108 (1971), and 2) *Advances in Electronics and Electron Physics,* Volume 33A, pages 153–165 (1972).

Millar's approach again involves the use of a microchannel plate (MCP). In this device, however, the MCP is used purely as an electron multiplication device and not as an x-ray conversion screen. The conversion factor for Millar's tube is reported to be around 200,000 cd-sec/m$^2$-R, which is about or higher than needed for fluoroscopic purposes. However, the output brightness of Millar's tube also exhibits strong dependence on the photocathode current density. At around a photocathode current density of $5 \times 10^{-11}$ amperes/cm$^2$ or at the equivalent x-ray input dose rate of around $0.6 \times 10^{-3}$ R/sec, the output brightness of the tube starts to become sublinear in response with respect to the input x-ray dose rate. The sublinear response becomes worse at higher x-ray dose rate. This undesirable feature reduces contrast discrimination during fluoroscopy. Again, it is unknown whether a large format MCP beyond five inches in diameter, self supporting and with uniform gain, can be fabricated.

The Millar proximity type image intensifier tube has a glass envelope and an inwardly concave, titanium input window. The window is described as being 0.3mm thick. Materials such as titanium, aluminum and beryllium cause undesirable scattering of the x-rays which reduces the image quality. Furthermore, because of the relatively high porosity and low tensile strength properties of such materials, they cannot be made as thin as desirable to maximize their x-ray transmissive properties as windows for a high vacuum device. Still another problem with tubes constructed with such materials for the input window and glass for the tube envelope is in joining the window of sufficiently large area to the tube envelope. The materials have such dissimilar thermal expansion properties, among other differences as to preclude their practical commercial use in a large format device.

As is suggested by the foregoing description of prior art direct x-ray viewing attempts, the problems of designing a proximity type x-ray image intensifier tube which is both convenient to use and is of sufficient gain and resolution are highly complex in their interrelationships. For example, one way to achieve high gain with a proximity device is to increase the high voltage applied between the scintillator-photocathode screen and the output display screen. Unfortunately this is limited by the problem of field emission, which is indeed pointed out by Millar and others. By increasing the spacing between the scintillator-photocathode screen and the output display screen, could allow increase in voltage, but as Millar pointed out, this also has the effect of greatly deteriorating the image quality due to electrostatic defocusing.

Another problem of prior art direct x-ray image viewing attempts is in minimizing the patient dosage while maximizing the x-ray image information content at the scintillator-photocathode screen. If the scintillator screen is made thicker, to thereby be more efficient in stopping x-rays, it also adds "unsharpness" to the picture. This would be unacceptable in the conventional inverter type x-ray image intensifier tube and optical viewing system because there are already many other sources of "unsharpness" such that the image quality of the total system is just barely acceptable.

SUMMARY OF THE INVENTION

The above and other disadvantages of prior art direct viewing x-ray fluoroscopic and x-ray image intensifier systems are overcome by the present invention of a directly viewable, x-ray sensitive image intensifier tube comprising an essentially metallic tube envelope, a metallic input window in the tube envelope, a flat, directly viewable output phosphor display screen, a flat scintillator-photocathode screen which is operated at negative high potential with respect to the remaining tube components including the tube envelope and the output display screen, and which is suspended parallel to the output screen with insulating posts in between the input window and the output screen, and means for applying the high voltage potential to the scintillator-photocathode screen. In the preferred embodiments, the brightness gain (conversion efficiency) is in excess of 4,000 cd-sec/m$^2$-R, the gap spacing between the scintillator-photocathode screen and the output screen is at least 8mm, and the thickness of the scintillator is at least 200 microns, whereby high x-ray utilization, high gain, and low field emission are simultaneously obtained. All components of the tube are thus linear in their response with respect to the input x-ray dosage.

Although the image intensifier tube used in the preferred embodiment of the invention has an essentially flat or planar input x-ray sensitive screen, it may be slightly curved for the purpose of increasing the mechanical strength of the screen, in other embodiments. The tube is quite thin and compact in size compared to a conventional image intensifier system. The input area can be square, rectangular or circular in shape in the various embodiments. As discussed above, in a conventional inverter type image intensifier tube the input screen is limited to a circular disk shape and is commonly outwardly curved.

The proximity type image intensifier tube used in the invention can be constructed to operate with only two electrodes, unlike conventional image intensifier tubes which usually have four to five electrodes. Thus, the image intensifier tube and the overall system of the invention are not sensitive to voltage drift. The electrical field in the space between the input and output screens of the image intensifier tube of the present invention is quite high compared to a conventional tube and the cathode region field strength is about 100 times higher than that of a conventional tube, thus it is not sensitive to external magnetic fields and defocusing problems encountered when subjected to bursts of high intensity, short millisecond duration pulses.

Furthermore, since the metallic tube envelope and all of the basic tube components except the scintillator-photocathode screen are at a neutral potential with respect to the output display screen, spurious electron emission is avoided, resulting in a cleaner display. More importantly, the additional advantage is that this tube is extremely safe to handle and that this tube can be easily mounted inside other equipment. All this is due to the fact that all high voltage components are kept inside the exterior walls of the tube. The high voltage connection is also well recessed inside the tube walls so that corona free connection can be easily made with an insulated high voltage cable.

The high gain achieved by the system of the invention together with the higher input informational content obtained with the thicker (in excess of 200 microns) than conventional scintillator-photocathode screens are both achieved with still higher x-ray image quality at the display screen than the conventional TV fluoroscopic systems. This thicker screen provides greater x-ray photon utilization, i.e., x-ray stopping ability, so that a lower patient dosage can be used than in a conventional system.

Unlike the proximity x-ray image intensifiers heretofore discussed, the present invention achieves high conversion efficiency without requiring the use of additional multiplication means or non-linear responding components, i.e., a microchannel plate between the output phosphor screen and the photocathode. As a result, the x-ray image intensifer tube of the present invention is mechanically simpler, more reliable and exhibits a linear response with respect to input x-ray dosages in excess of 0.06 R/sec.

Among the main advantages of the invention are the light weight, the simplicity of the system and that it can be used in x-ray fluoroscopy without requiring dark-adaptation. In this way, the physician can have easy access to the patient for palpation and can observe the effects of palpation without having to turn away from the patient, as is necessary in the present day systems having an inverter type image intensifier coupled to a television display.

In other embodiments of the invention, such as for use in teaching institutions, for example, it may be desirable to provide remote displays of the output of the x-ray image intensifier tube. In these embodiments the x-ray image intensifier tube's large output display screen is quite easily coupled to a silicon intensifier target (SIT) tube type closed circuit television system for remote viewing or for video recording.

Still another advantage is that the x-ray sensitive area input format size of the system can be expanded without sacrificing image quality as would happen with conventional inverter type image intensifier systems.

It is therefore an object of the present invention to provide a fluoroscopic system having a flat x-ray conversion input screen to reduce image distortion.

It is another object of the invention to provide an x-ray image intensifier tube having a substantially full size display which can be directly viewed without optical aids for use in fluoroscopy.

It is yet another object of the invention to provide a panel type x-ray image intensifier tube for direct x-ray viewing which minimizes the input x-ray dosage to the patient while still providing a high quality display image.

It is a further object of the invention to provide a panel type x-ray image intensifier tube having directly viewable output display which is aligned with that portion of the patient which is being irradiated by the x-rays.

It is a still further object of the invention to provide an x-ray image intensifier tube capable of having either a square, rectangular or circular or other freely shaped input format.

It is yet a further object of the invention to provide an x-ray image intensifier tube which is not sensitive to the effects of voltage drifts, external magnetic fields, and field emission.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
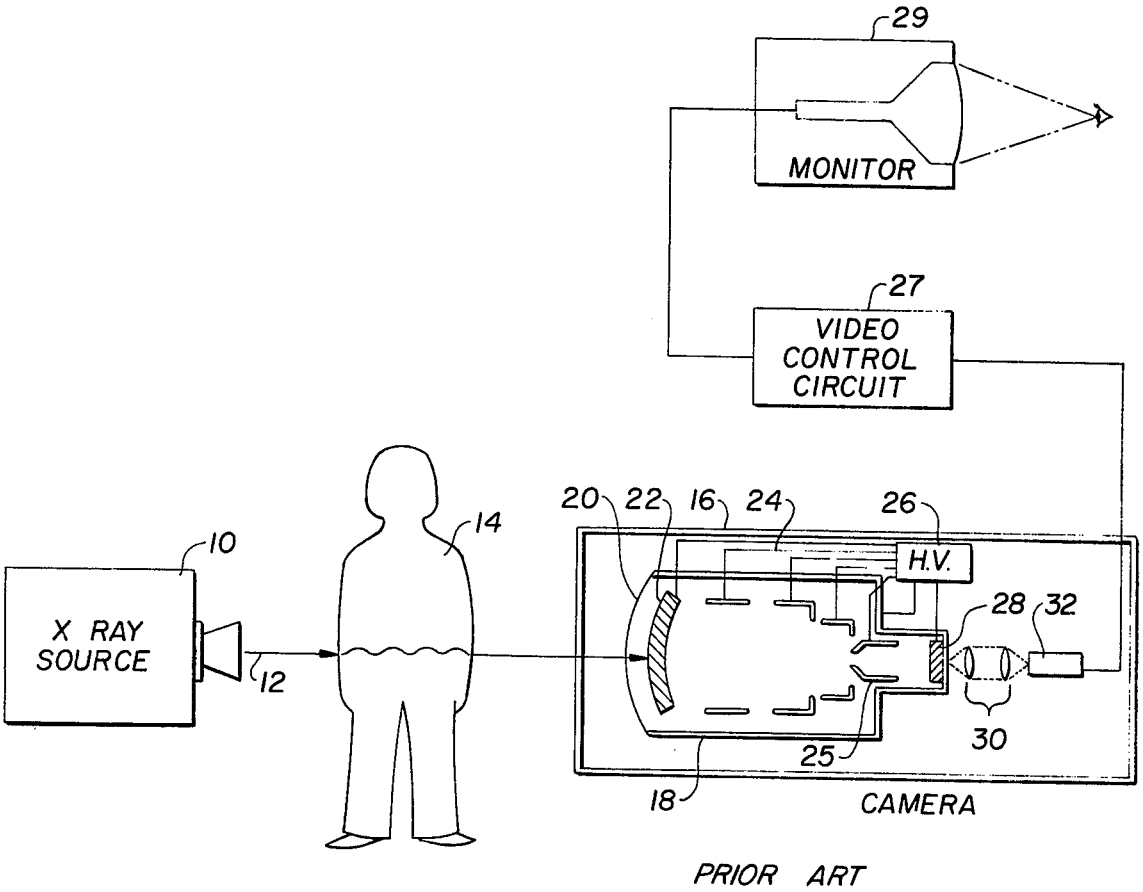
FIG. 1 is a diagrammatic illustration of a conventional, inverter type image intensifier x-ray fluoroscopic system.

Referring now more particularly to FIG. 1, a conventional fluoroscopic system employing an inverter type x-ray image intensifier tube is illustrated. An x-ray source 10 generates a beam of x-rays 12 which pass through the patient's body 14 and casts a shadow image onto the face of the fluoroscopic system 16. This system includes a conventional inverter type image intensifier vacuum tube 18. The tube 18 has an outwardly convex input window 20 and a correspondingly convex scintillator screen and photocathode assembly 22.The purpose of this scintillator screen, as is well known to those skilled in that art, is to convert the x-ray shadow image into a light image, which, in turn, is immediately converted by the photocathode layer into a pattern of electrons. This pattern of electrons is electrostatically accelerated by a set of electrodes 24 and anode 25 near the display screen 28 and is focused by this set of electrodes 24 and anode 25 to form an image on the small output screen 28. The electrodes 24 and the anode 25 are connected to a high voltage source 26 whose other lead is connected to the scintillator and photocathode screen assembly 22. The tube body is made of insulating glass. The image at the output display screen 28 is magnified by a short focal length optical system 30 and is projected onto the sensitive area of the closed-circuit television camera tube 32. The video signal from the camera tube is processed and amplified by a control circuit 27, and the image is displayed on a monitor screen 29.

The brightness gain of the image by the tube 18 is due partly to the electron acceleration and partly to the result of electronic image minification. This is the result of reducing the image generated on the scintillator screen 22 down to a relatively small image at the output display screen 28. The reduced image on the display screen 28 is too small however, to allow direct viewing without optical aids. Moreover, the quality of the image is reduced both by the quality of the electron optics and by the quality of the output phosphor screen in the electronic image minification, and by the subsequent enlarging of the output image onto the monitor screen by the closed circuit television system. Another problem is that the closed circuit television is of the magnifying type so that the output image along with defects on the output screen are magnified onto the television monitor screen.

There are many other disadvantages to such a conventional x-ray fluoroscopic system. One of the disadvantages is that because of the added complexity of the closed circuit television system, the reliability of the system is compromised. Another disadvantage is the bulk size and heavy weight of the system which prevents easy access to the patient for palpation and also makes movement or "panning" of the equipment difficult. Some equipment has "power drive" features, but it further compromises the reliability of the system.

Still another disadvantage is that because of the curved scintillator screen 22, there is a spatial distortion produced in the image due to x-ray projection on the curved surface and due to the field configuration in the tube. Another problem is that because of the weak field near the cathode region and the multi-electrode arrangement 24, the tube 18 is extremely sensitive to external magnetic fields and voltage drifts among the electrodes. Both of these factors can cause distortion and unsharpness in the produced image.

Yet another problem is that because of the greatly minified output image and the short focal length optics 30, any change in the positioning of the elements of the optical system with respect to the photo sensitive layer of the camera tube 32 or the output screen 28, will render the image out of focus. This can result from vibration or from thermal expansion.

One other major disadvantage of the conventional system is that because of the curved glass window 20 which is necessary to withstand the pressures due to the vacuum inside the tube 18 and the already very weak field strength in the cathode region, the system is limited to approximately nine inches in input format for optimum performance. Any greater diameter input will necessitate a much higher tube voltage and a thicker input window which would cause increased problems due to ion spots inside the tube and x-ray transmission and scattering in the input window. There is also, of course, the danger to the patient and the radiologist that the tube might fracture causing an implosion and resulting ejection of the glass fragments.

Figure 2:
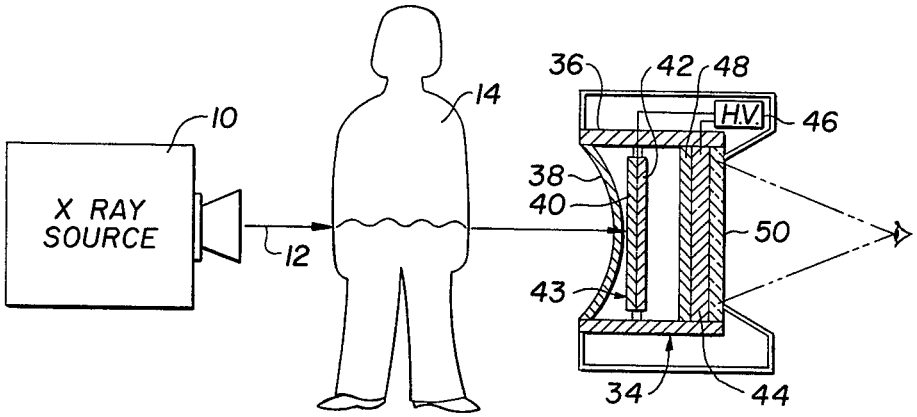
FIG. 2 is a diagrammatic illustration of the x-ray image intensifier tube according to the invention.
Figure 3:
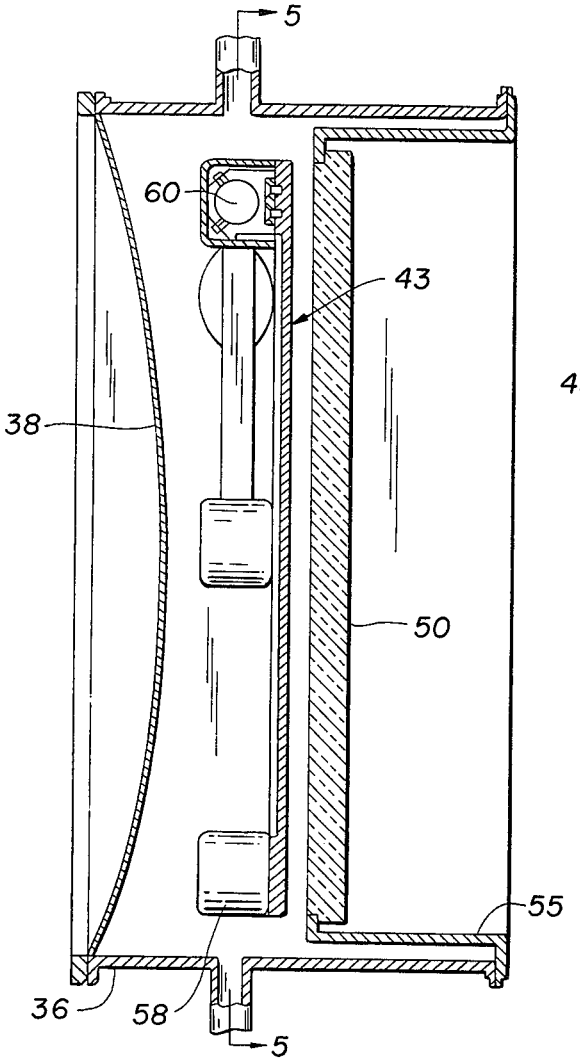
FIG. 3 is a detailed vertical view, in section, of the image intensifier tube of the invention.

Referring now more particularly to FIG. 2, a panel shaped proximity type x-ray image intensifier tube according to the invention is illustrated. The image intensifier tube 34 comprises a metallic, typically type 304 stainless steel, vacuum tube envelope 36 and a metallic, inwardly concave input window 28. The window 38 is made of a specially chosen metal foil or alloy metal foil in the family of iron, chromium, and nickel, and in some embodiments, additionally combinations of iron or nickel together with cobalt or vanadium. It is important to note that these elements are not customarily recognized in the field as a good x-ray window material in the diagnostic region of the x-ray spectrum. By making the window thin, down to 0.1 mm in thickness, the applicant was able to achieve high x-ray transmission with these materials and at the same time obtain the desired tensile strength. In particular, a foil made of 17-7 PH type of precipitation hardened chromium-nickel stainless steel is utilized in the preferred embodiment. This alloy is vacuum tight, high in tensile strength and has very attractive x-ray properties: high transmission to primary x-rays, low self-scattering, and reasonably absorbing with respect to patient scattered x-rays. The window 28 is concaved into the tube like a drum head.

The use of materials which are known for high x-ray transmission such as beryllium, aluminum and titanium for example cause the undesirable scattering which is present in some prior art proximity type, x-ray image intensifier devices.

One purpose of having a metallic window 38 is that it can be quite large in diameter with respect to the prior art type of convex, glass window 22, as depicted in FIG. 1, without affecting the x-ray image quality. In one embodiment, the window measures 0.1 mm thick, 25 cm by 25 cm and withstood over 100 pounds per square inch of pressure. The input window can be square, rectangular, or circular in shape, since it is a high tensile strength material and is under tension rather than compression.

The x-ray image passing through the window 38 impinges upon a flat scintillation screen 40 which converts the image into a light image. This light image is contact transformed directly to an immediately adjacent flat photocathode screen 42 which converts the light image into a pattern of electrons. The scintillator and photocathode screens 40 and 42 comprise a complete assembly 43. The electron pattern on the negatively charged screen 42 is accelerated towards a positively charged flat phosphor output display screen 44 by means of an electrostatic potential supplied by a high voltage source 46 connected between the output screen 44 and the photocathode screen 42. Although the display screen 44 is positive with respect to the scintillator-photocathode screen assembly 43, it is at a neutral potential with respect to the remaining elements of the tube, including the metallic envelope 36, to thereby reduce distortion due to field emission. No microchannel plate is interposed between the output phosphor screen and the photocathode screen as is done in some prior embodiments. The use of such a non-linear device (with respect to input x-ray dosage) causes distortion in and of itself but it also increases the deleterious field emission effects since some of the elements of the microchannel plate must operate at different electrostatic potentials with respect to the output display screen and thereby become sources for spurious electron emission.

It should be noted that substantially no focusing takes place in the tube 34 as opposed to the prior art type tube 18 in FIG. 1. The screen 40, the photocathode layer 42 and the display screen 44 are parallel to each other. Also, the gap spacing between the photocathode 42 and the display screen 44 are relatively long, in the range of 8 to 25 millimeters, thereby reducing the likelihood of field emission and at the same time keeping the electrostatic defocusing to a tolerable level, that is, around 2.0 to 3.0 line pairs per millimeter. This is still better than the typical 1.5 line pairs per millimeter limiting resolution of the conventional TV fluoroscopic system.

Furthermore, the applied voltage across the gap between photocathode layer 42 and the display screen 44 is in the range of 20,000 to 60,000 volts (20 to 60 Kv) which is higher than in Millar's tube, described earlier in this application. In addition, the non-focusing nature of the field avoids the ion spot problem which plagues inverter type tubes. In the preferred embodiments of the invention, the spacing between the photocathode screen 42 and the output display screen 44 is between 8mm (at 20 Kv) and 25mm (at 60 Kv). Thus, the voltage per unit of distance, i.e., the field strength, is at least 2 Kv/mm. An upper limit to the field strength is about 5 Kv/mm. In prior art devices such a high field strength was not considered feasible for this application of an image intensifier device because of the field emission problems discussed above and which are obviated in the applicant's device by having all of the tube elements, save for the photocathode-scintillator screen assembly, be at a neutral potential with respect to the output display screen.

The scintillation screen 40 can be calcium tungstate ($CaWO_4$) or sodium activated, cesium iodide (CsI(Na)) or any other type of suitable scintillator material. However, vapor deposited, mosaic grown scintillator layers are preferred for the highly desired smoothness and cleanliness. Since such materials and their methods of application are well known to those skilled in the art, see for example, U.S. Pat. No. 3,825,763, they will not be described in greater detail.

The overall thickness of the scintillator screen 40 is chosen to be at least 200 microns thick to give a higher x-ray photon utilization ability than prior art devices, thereby allowing overall lower patient x-ray dosage levels without a noticeable loss of quality as compared to prior art devices. This is because the format of the tube and the high gain produced by the high field strength give an extra margin of sharpness to the image which can be traded off in favor of lower patient dosage levels with greater x-ray stopping power at the scintillator screen 40.

Similarly, the photocathode layer 44 is also of a material well known to those skilled in the art, being cesium and antimony ($Cs_3Sb$) or multi-alkali metal (combinations of cesium, potassium and sodium) and antimony.

The image produced on the phosphor screen 44 is the same size as the input x-ray image. The output phosphor screen 44 can be of the well known zinc-cadmium sulfide type (ZnCdS(Ag)) or zinc sulfide type (ZnS(Ag)) or a rare earth material like yttrium oxysulfide type ($Y_2O_2S$(Tb)) or any other suitable high efficiency blue and/or green emitting phosphor material. The interiorly facing surface of the output screen is covered with a metallic aluminum film 48 in the standard manner. The phosphor layer constituting the screen 44 is deposited on a high Z glass output window 50. By high Z is meant that the window glass has a high concentration of barium or lead to reduce x-ray back scatter inside and outside the tube and to shield the radiologist from both primary and scattered radiation. In contrast to prior art x-ray image intensifier tubes whose output phosphor screen thickness is limited by considerations of resolution and tube voltage to a thickness of about 1.0 mg/cm$^2$, the screen 44 of the present invention is much thicker, on the order of 2 to 4 mg/cm$^2$. Since the display in the present invention is full sized, resolution is much less of a problem and the higher tube voltage produces an electron velocity from the photocathode which is more effectively stopped by the thicker screen. This also increases the light output of the display to give greater brightness gain.

An important factor in determining the usefulness of any x-ray image intensifier system for fluoroscopic purposes is the conversion efficiency of the tube. The conversion efficiency of the image intensifier tube is measured in terms of output light energy in ergs per square centimeter per x-ray input dosage of 1 roentgen (erg/cm$^2$-R), which can also be expressed in terms of candela-second per square meter-roentgen (cd-sec/m$^2$-R) if a green emitting output phosphor like ZnCdS(Ag) type is used.

Several nine inch diameter working proximity type image intensifier tubes have been constructed according to the invention with a 20mm gap spacing and 250 micron CsI(na) scintillator and achieved a conversion efficiency in the range of 35,000 to 60,000 erg/cm$^2$-R. The output phosphors are of the ZnCdS(Ag) type and thus the conversion efficiency can also be expressed in photometric terms as 5000 to 8000 cd-sec/m$^2$-R. This is about equivalent to a brightness gain of 500 to 800 times over that of the old-time fluoroscopic screens.

Figure 4:
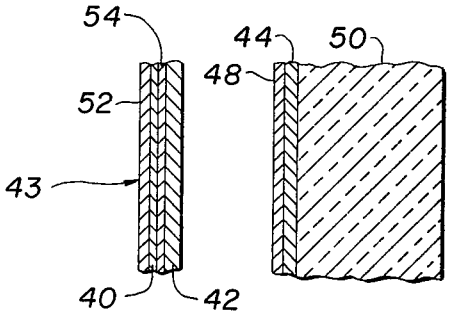
FIG. 4 is an enlarged, vertical view of the encircled detail in FIG. 3, illustrating a cross-section of a portion of the image intensifier tube depicted in FIG. 3.

It is important to compare these results with those reported in the Millar article referred to above. The overall conversion efficiency of Millar's tube is 196 to 200 cdm$^{-2}$mR$^{-1}$sec or 196,000 to 200,000 cd-sec/m$^2$-R which is obtained with the MCP operating at 10,000 gain. Removing the MCP and its gain would result in a conversion efficiency around 20 cd-sec/m$^2$-R, which is too low for fluoroscopy purposes. Therefore, Millar's article has the effect of leading away from the present invention Referring now more particularly to FIG. 4, in a cross-sectional view, the details of the scintillation and photocathode screen assembly 43 and the output display screen assembly 44 are illustrated. The screen assembly 43 comprises a scintillator layer 40 of very smooth calcium tungstate or sodium activated cesium iodide which is vapor deposited on a smoothly polished nickel plated aluminum substrate or an anodized aluminum substrate 52 which faces the input window 38. The techniques of such vapor deposition processes are known to those skilled in the art, see for example, U.S. Pat. No. 3,825,763. For direct viewing purposes, the layer 40 is between 200 to 600 microns thick.

As mentioned above, the purpose of the scintillator screen 40 is to convert the x-ray image into a light image. On the surface of the scintillation layer 40 which faces away from the substrate 52, a thin, conductive, transparent electrode layer 54 such as a vapor deposited metallic foil, i.e., titanium or nickel, is deposited and on top of this is deposited the photocathode 42. The photocathode layer 42 converts the light image from the scintillator layer 40 into an electron pattern image and the free electrons from the photocathode 42 are accelerated by means of the high voltage potential 46 toward the display screen 44, all as mentioned above. The scintillator-photocathode screen 43 in this invention is suspended from the tube envelope 36 between the input window 38 and the output screen 44 by several insulating posts 58. One or more of these posts may be hollow in the center to allow an insulated high voltage cable 60 from the source 46 to be inserted to provide the scintillator photocathode screen 43 at the layer 54, with a negative high potential. The remaining parts of the intensification tube including the metallic envelope 36, are all operated at ground potential. This concept of minimizing the surface area which is negative with respect to the output screen results in reduced field emission rate inside the tube and allows the tube to be operable at higher voltages and thus higher brightness gain. It also minimizes the danger of electrical shock to the patient or workers if one should somehow come in contact with the exterior envelope of the tube.

To reduce charges accumulated on the insulating posts 58, they are coated with a slightly conductive material such as chrome oxide which bleeds off the accumulated charge by providing a leakage path of better than 20 Kv/cm.

The thick, high atomic number (Z) glass substrate 50 on which the phosphor display screen 44 is deposited forms one exterior end wall of the vacuum tube envelope 36. This glass substrate 50 is attached to the tube envelope 36 by means of a collar 55 made of an iron, nickel, chromium alloy, designated to the trade as "Carpenter, No. 456". Since the thermal coefficient of expansion of this alloy matches that of the glass and nearly matches that of the tube envelope 36, the collar 55 can be fritted to the glass substrate 50 and welded to the tube envelope 36. On the interior surface of the glass wall 50 is deposited the phosphor layer 44 which is backed by a protective and electron-transparent aluminum thin film 48 to prevent light feedback and to provide a uniform potential. It also tends to increase the reflection of the phosphor layer 44 to give a higher light output gain.

The essentially all metallic and rugged construction of the tube minimizes the danger of implosion. The small vacuum space enclosed by the tube represents much smaller stored potential energy as compared with a conventional tube which further minimizes implosion danger. Furthermore, if punctured, the metal behaves differently from glass and the air simply leaks in without fracturing or imploding.

The photocurrent drawn by the tube from the power supply 46 is dependent, of course, on the image surface area of the scintillator-photocathode screen assembly 43 and the output display screen 44. For a tube used for direct viewing, the photocurrent would be 0.4 to 0.8 $\times 10^{-9}$ amperes/cm$^2$ at an x-ray dosage level of 1 mR/sec.

Figure 7:
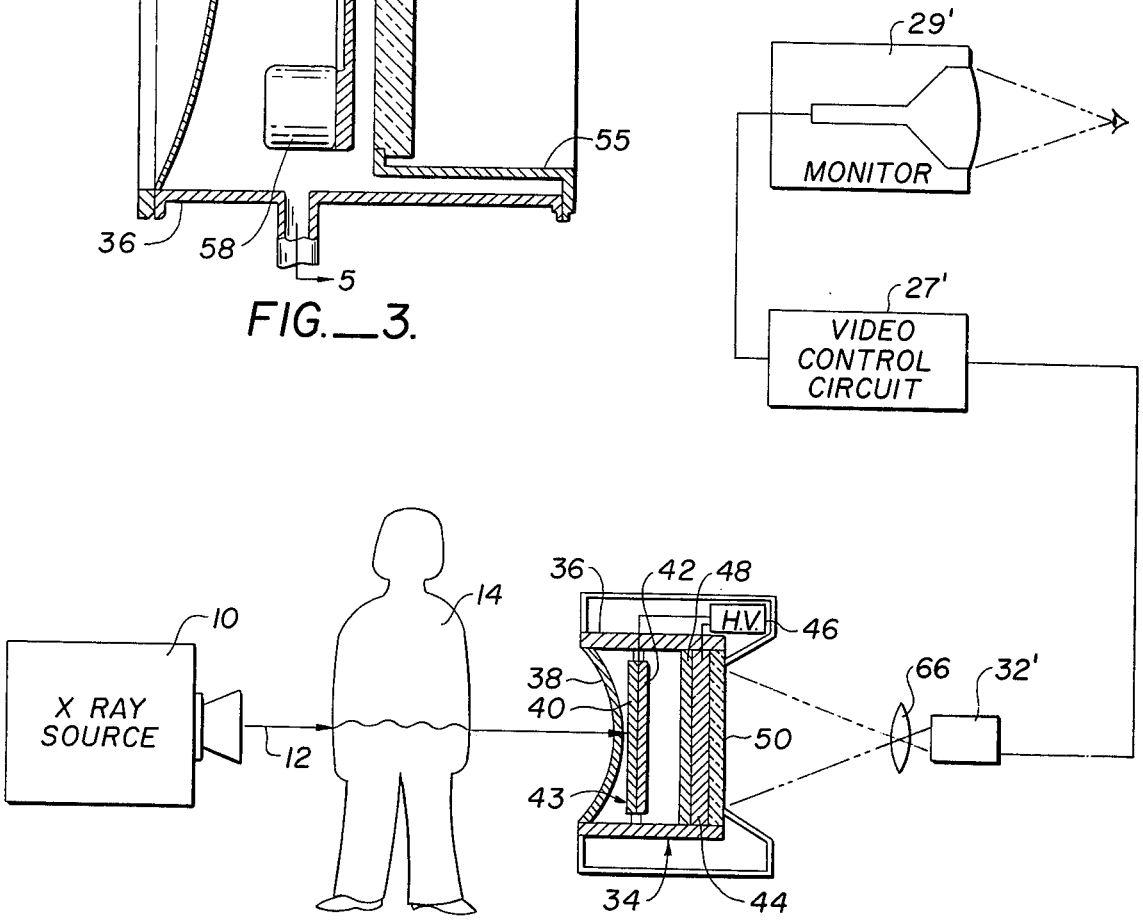
FIG. 7 is a diagrammatic illustration of the x-ray image intensifier tube of the present invention when used in a closed circuit television monitoring system.
Figure 5:
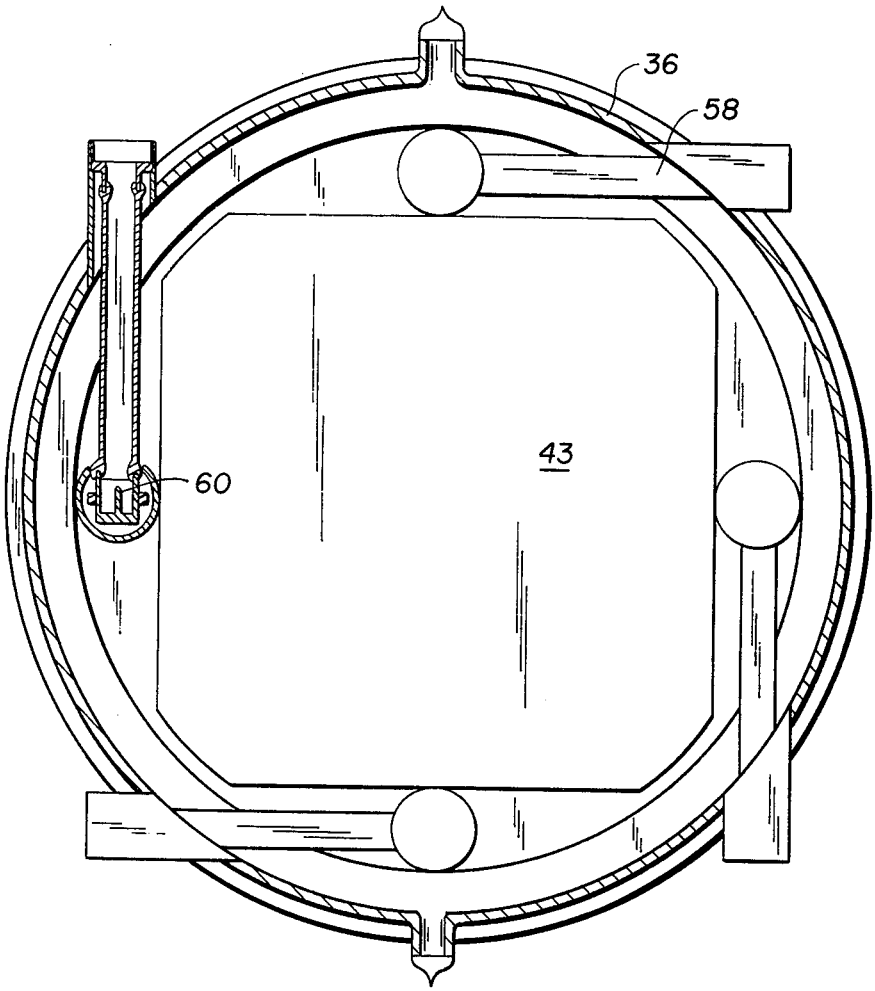
FIG. 5 is a vertical, sectional view, taken generally along the line 5—5 in FIG. 3, of the image intensifier tube according to the invention.
Figure 6:
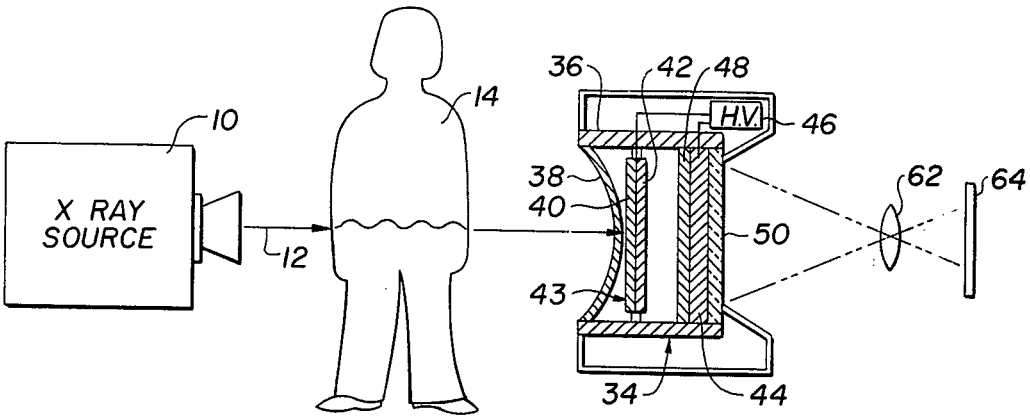
FIG. 6 is a diagrammatic illustration of the x-ray image intensifier tube of the present invention when used in a radiographic camera.

Referring now more particularly to FIG. 6, the x-ray image intensifier tube 34 of the invention can, in some embodiments, also be used as a radiographic camera by focusing the output display image on the screen 44 with a lens 62 onto suitable radiographic film 64. In still another embodiment, as shown in FIG. 7, the output display can be focused by a lens 66 onto the photo sensitive layer of a closed circuit television camera tube 32' of the type of closed circuit monitoring system described above in reference to FIG. 1. Of course, by the use of suitable prisms or semi-reflecting mirrors, direct view fluoroscopy, radiography and closed circuit TV monitoring can all take place simultaneously.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. A directly viewable, x-ray sensitive image intensifier tube comprising:

a metallic tube envelope open at both ends, an inwardly concave metallic input window at one end of the envelope, a flat, directly viewable, output phosphor display screen mounted at the other end of the envelope, a flat, scintillator-photocathode screen, electrically insulating means for suspending the scintillator-photocathode screen within the envelope and in a plane parallel to, but spaced apart from, the output display screen, and means for applying a high, negatively charged, electrostatic potential to the scintillator-photocathode screen, the potential being taken with respect to the output display screen and all of the other tube elements, including the envelope which are at a neutral potential with respect to each other.

2. A directly viewable, x-ray sensitive image intensifier tube as recited in claim 1, wherein the spacing between the scintillator-photocathode screen and the output display screen is at least 8mm and the potential between them is at least 20 Kv.

3. A directly viewable, x-ray sensitive image intensifier tube as recited in claim 2, wherein the ratio of the potential to the spacing is not greater than 5 Kv/mm.

4. A directly viewable, x-ray sensitive image intensifier tube as recited in claim 1, wherein the scintillator-photocathode screen comprises an alkaline-halide scintillator layer having a thickness of at least 200 microns and which faces the input window, and an adjacent photocathode layer which faces the display screen.

5. A directly viewable, x-ray sensitive image intensifier tube as recited in claim 1, wherein the scintillator-photocathode screen produces an electron pattern image corresponding to the x-ray input image to the tube, the intensity of the electron pattern image being linear with respect to the intensity of the input x-ray dosage, and wherein the electron pattern image is accelerated directly toward the output display screen from the scintillator-photocathode screen by the electrostatic potential between them.

6. A directly viewable, x-ray sensitive image intensifier tube as recited in claim 1, wherein the brightness gain (conversion efficiency) of the tube is in excess of 4,000 cd-sec/m-R.

7. A directly viewable, x-ray sensitive image intensifier tube as recited in claim 1, wherein the insulating means comprise insulating support rods and a semi-insulating coating over the support rods to bleed off accumulated charge on the rods.

8. A directly viewable, x-ray sensitive image intensifier tube as recited in claim 1, wherein the output display screen has a thickness of at least 2 mg/cm$^2$.

9. A fluoroscopic device having a directly viewable x-ray sensitive image intensifier tube, the tube comprising a hollow, metallic envelope having two open ends, a metallic, inwardly concave, input window mounted to seal one open end of the envelope, a directly viewable, flat, output phosphor display screen mounted to seal the other open end of the envelope, a scintillator-photocathode screen assembly, the assembly including a flat, alkaline-halide scintillator screen and a flat photocathode screen parallel and immediately adjacent to the scintillator screen, insulating means for suspending the scintillator-photocathode screen assembly within the tube envelope and in a plane parallel to the output display screen, and means, including a source of high voltage exterior to the envelope, for applying a high negative potential to the scintillator-photocathode screen assembly taken with respect to the output display screen, the output display screen being at a neutral potential with respect to all of the other remaining tube elements within, and including, the envelope.

10. A fluoroscopic device as recited in claim 9, further comprising closed-circuit television monitoring means for displaying images presented on the output display screen of the image intensifier tube.

11. A fluoroscopic device as recited in claim 9, further comprising means for radiographically recording images presented on the output display screen of the image intensifier tube.

* * * * *